US007000657B1

(12) United States Patent
Thorpe et al.

(10) Patent No.: US 7,000,657 B1
(45) Date of Patent: Feb. 21, 2006

(54) INTERLOCKING FUEL NOZZLE

(76) Inventors: Douglas G. Thorpe, 707 Broadway, Irvine, KY (US) 40336; Norwood Thorpe, 68 Forest Hill Dr., Irvine, KY (US) 40336

( * ) Notice: Subject to any disclaimer, the term of this patent is extended or adjusted under 35 U.S.C. 154(b) by 0 days.

(21) Appl. No.: 11/037,929

(22) Filed: Jan. 19, 2005

(51) Int. Cl.
*B65B 1/30* (2006.01)

(52) U.S. Cl. ..... 141/207; 141/346; 141/392

(58) Field of Classification Search ..... 141/94, 141/206, 207, 311 R, 346, 347, 383, 386, 141/392; 251/149.9; 137/614.06
See application file for complete search history.

(56) References Cited

U.S. PATENT DOCUMENTS

| | | | | |
|---|---|---|---|---|
| 1,457,535 A | | 6/1923 | McCune | |
| 1,515,844 A | | 11/1924 | Dorris | |
| 1,726,044 A | | 8/1929 | Seidel | |
| 2,547,690 A | | 4/1951 | Chadil et al. | |
| 3,502,121 A | | 3/1970 | Moore et al. | |
| 4,354,536 A | * | 10/1982 | Moss | 141/383 |
| 4,557,302 A | | 12/1985 | Sunderhaus | |
| 5,236,023 A | * | 8/1993 | Mohr | 141/312 |
| 5,301,723 A | * | 4/1994 | Goode | 141/82 |
| 5,385,182 A | * | 1/1995 | Dyer | 141/392 |
| 6,123,123 A | | 9/2000 | Carder et al. | |
| 2001/0023559 A1 | | 9/2001 | Ozawa et al. | |

* cited by examiner

*Primary Examiner*—Timothy L. Maust
(74) *Attorney, Agent, or Firm*—Glyde I Coughenour

(57) ABSTRACT

Drive off is prevented by having a grasp assembly engage the restrictor plate of the fill pipe of a motor vehicle when the nozzle spout is inserted. After the fuel pump is started and pressure is placed on the fuel, fuel is admitted into the nozzle by pressing on the hand lever to open the poppet valve. Fuel pressure in the nozzle activates a lock actuator system, to prevent removal of the spout from the fill pipe, by a lock system that prevents a grasp assembly latch from retracting from the fill pipe restrictor plate.

17 Claims, 4 Drawing Sheets

INTERLOCKING FUEL NOZZLE

BACKGROUND OF THE INVENTION

1. Field of the Invention

A fuel dispensing nozzle at a filling station is provided with a mechanism that engages with the fill pipe activated by the initial insertion of the spout. The mechanism is locked in position by fuel pressure that can only be inactivated remotely by removal of fuel pressure or paid at the pump override, thereby preventing drive off without payment.

2. Description of Related Art

The concept of providing fuel nozzles with spout extensions to secure the nozzle to a fuel tank to prevent spilling and need to hold the nozzle are old. M. McCune, U.S. Pat. No. 1,457,535, issued Jun. 5, 1923, and L. Dorris, U.S. Pat. No. 1,515,844, issued Nov. 18, 1924, and, J. Seidel, U.S. Pat. No. 1,726,044, issued Aug. 27, 1929, and R. Chadil et al, U.S. Pat. No. 2,547,690, issued Apr. 3, 1951, and G. Moore et al, U.S. Pat. No. 3,502,121, issued Mar. 24, 1970, and C. Sunderhaus, U.S. Pat. No. 4,557,302, issued Dec. 10, 1985, are examples. The use of pull away parts to preclude unnecessary damage when a vehicle operator pulls off with the nozzle still in the fill pipe is known with M. Carder et al, U.S. Pat. No. 6,123,123, issued Sep. 26, 2000, examples

SUMMARY OF THE INVENTION

With the advent of self service filling stations around the world, a huge expense to operators of such filling stations deals with intentional and non-intentional thievery of the petroleum product. At times, fuel is unintentionally stolen from filling stations due to the mistaken belief that a spouse paid for the fuel or the customer forgets to pay after spending an extended period of time in the filling station. However, most of the time the act of thievery is intentional. Unfortunately, the crime is not often pursued by the local authorities due to the low value of the crime of less than $30. If a fill station combats the thievery by a requirement of pre-paying for fuel, they lose many customers due to the added inconvenience. Gasoline drive-offs are a $272 million per year problem to the 153,200 gasoline dispensing convenient stores in the USA, as well as additional losses to all other non-prepay fuel dispensing stations throughout the world.

A fuel dispensing nozzle contains a handle driven poppet valve that allows the customer to manually regulate the approximate 10 psi of gasoline pressure delivered by the pump. The nozzle contains a disposable 13/16" diameter aluminum spout which is inserted past the gasoline tank filler inlet restrictor within the fill pipe on all unleaded vehicles since 1974. A trigger mechanism interacts with the customer's fill pipe to actuate an interlocking lever having a catch that will interlock with the inlet restrictor. The interlocking lever catch is locked in place by the 10 psi of gasoline fluid pressure. By requiring the cashier to turn off the pump, fluid pressure is removed from the nozzle to pivot the interlocking lever and permit the dispensing nozzle to be safely removed from the customer's vehicle at the cashier's convenience.

The interlocking lever catch is activated by pivoting a latch under the restrictor plate by engaging a trigger with the restrictor plate against spring pressure. The latch is locked in place by fuel pressure acting against a diaphragm that pulls a lock pin into a lock recess against spring pressure to prevent the latch from pivoting out of contact with the restrictor plate. When fuel pressure is released, by cutting off the pump, the diaphragm returns to a pre-full position that pushes the lock pin out of the lock recess by return lock pin spring pressure. The latch pivots from under the restrictor plate under trigger spring return pressure or force.

If the customer fails to pay the cashier and drives off while the fuel nozzle is still connected to the fill pipe, an OSHA mandated breakaway will disconnect the nozzle from the hose. The breakaway disconnects whenever a force of 350 lb. is applied and allows only a fraction of an ounce of fuel to spill. The cost of the break-away gasoline nozzle with modified spout, and re-installation of a new spout, will be more than the minimum felony threshold of $300.

DESCRIPTION OF THE PREFERRED EMBODIMENTS

Figure 1:
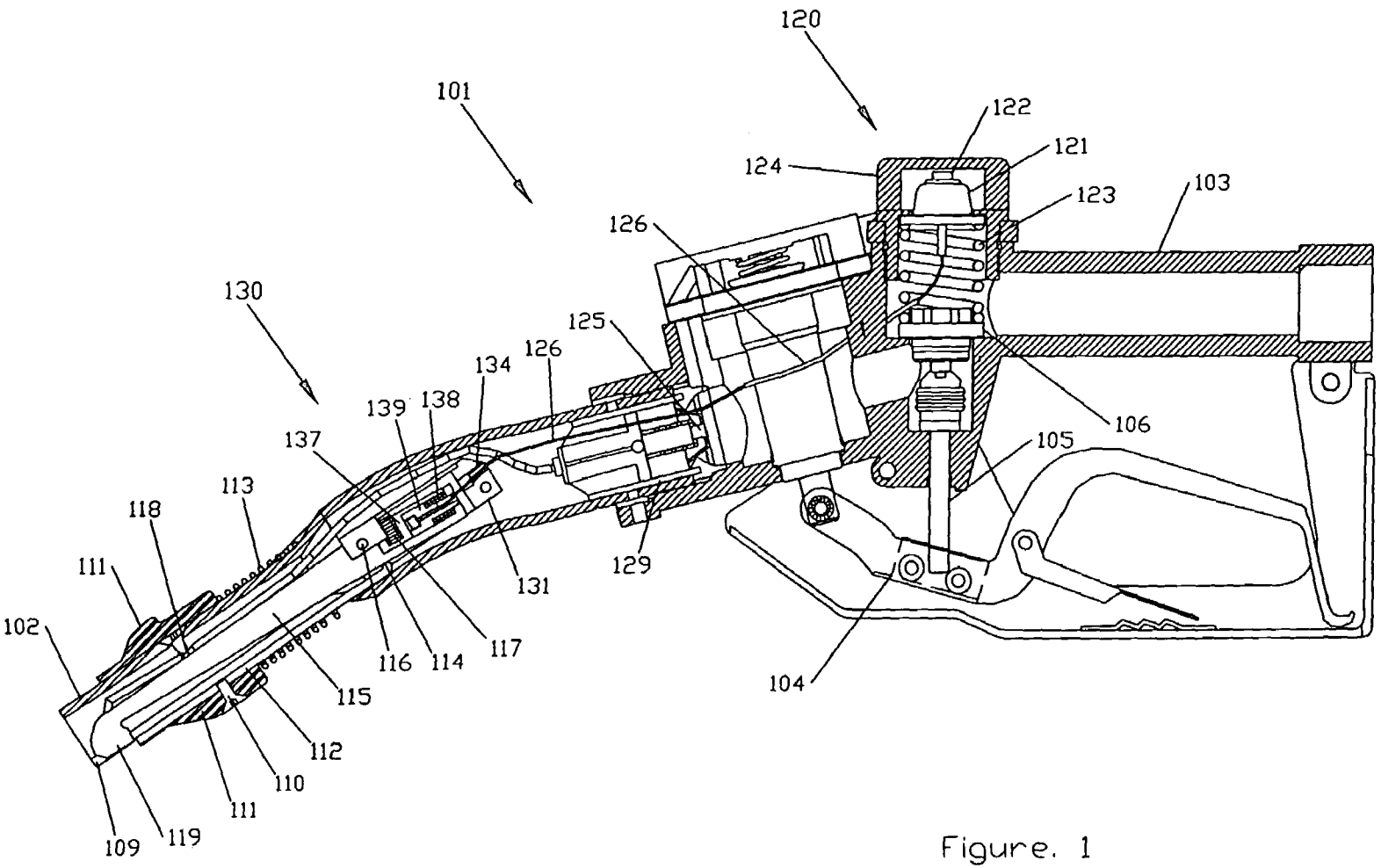
FIG. 1 is a side sectional view of the fuel nozzle showing the assemblies of the invention.

The invention combines or modifies the standard fuel nozzle 101 with a drive off prevention system by adding a fuel fill pipe restrictor grasp assembly 110, lock actuator assembly 120, and a locking assembly 130.

The standard fuel nozzle components include a nozzle housing 103, hand lever 104, valve stem 105, poppet valve 106, poppet valve spring 123 and venture 125 that conduct fuel to the vehicle fuel tank through the fill pipe restrictor plate 108 from a reservoir or storage tank.

The hand lever 104 provides the customer with the means to initiate the flow of fuel through the nozzle by exerting upward force on the valve stem 105 and on the poppet valve 106. The main poppet valve spring 123 must be compressed in order to allow fuel, present in the entry tube of the main body, to proceed through the main body and out to the spout 102. When a customer pulls up on the hand lever 104, the compression of this spring will permit the poppet valve to lift allowing fuel to proceed into the main body passage. Venturi 125 is the standard means of detecting that the vehicle fill pipe is full of fuel. The venturi produces a slight vacuum when fuel is flowing and sucks in air from the vent tube which has been routed to the distal end of the spout. The venturi can also produce a vacuum in the venturi housing 124.

Figure 2:
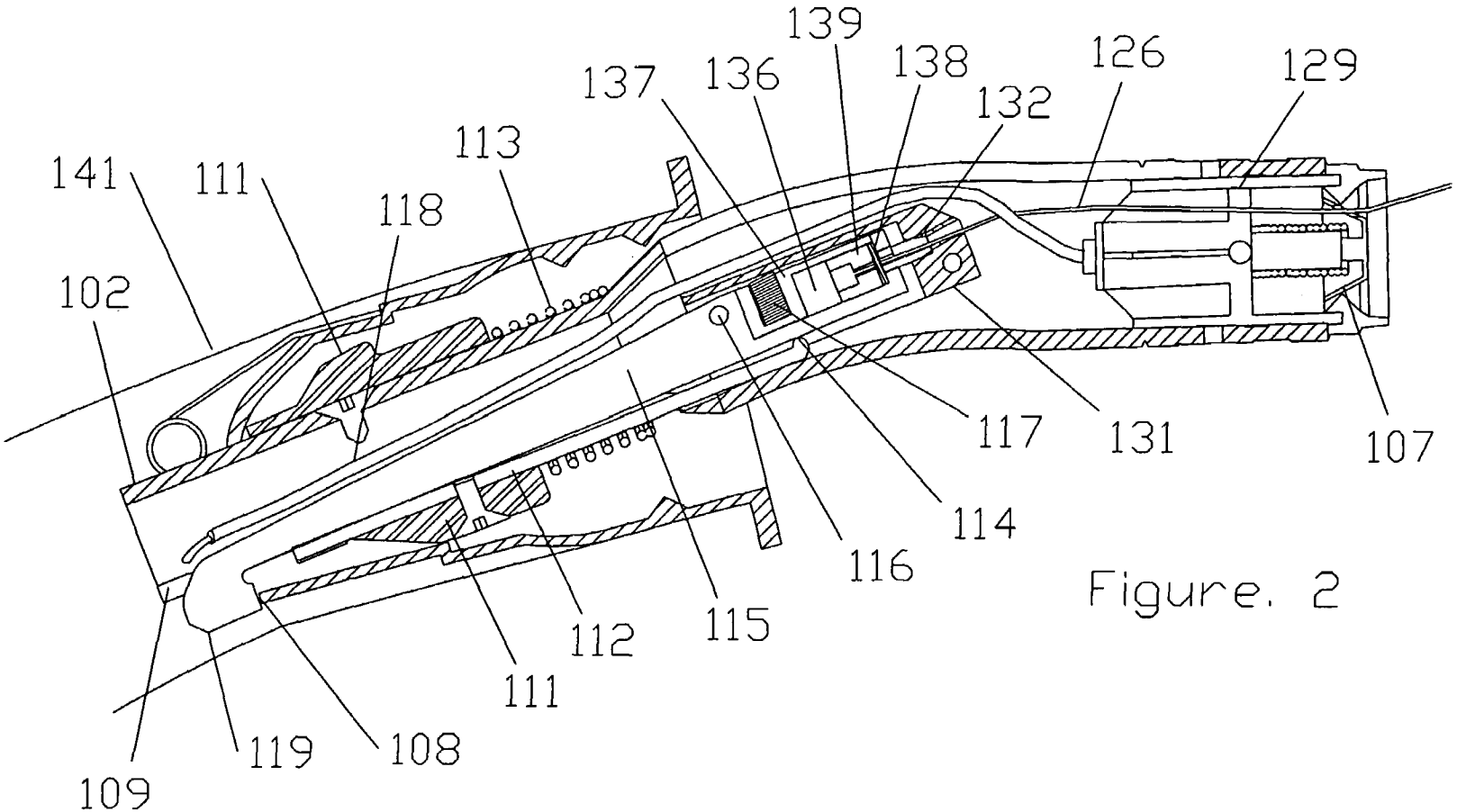
FIG. 2 is a partial side sectional view of the grasp and lock assembly shown in FIG. 1.

The elements of the grasp assembly 110, featured in FIG. 2, include the spout 102, the trigger 111, the slide arm 112, grasp spring 113, and the latch 115.

In this particular embodiment, the spout 102 is preferably constructed of a 13/16" OD diameter aluminum tube that is bent into a proper shape by a die-pressing operation. A slot 109 is cut into the straight end (the distal end) of the spout into which the latch 115 is inserted, and a widened body within the curved section of the spout provides for the locking pin housing assembly 130. This widened body of the spout is intended to maintain the flow rate through the spout, despite the small obstruction presented by the latch 115 and the locking pin housing assembly 130. The trigger 111 is attached to or is a part of the slide lever arm 112. The trigger 111 works with the slide lever arm 112 to cause the latch 115 to pivot about its fulcrum 116 that will engage the latch with the restrictor plate 108. The trigger 111 is spring loaded and will slide from the distal end of the spout 102 whenever the spout is inserted into a fill-pipe. When the trigger 111 is pushed back from its normal fully extended position, by action of the nozzle operator inserting the spout into the fill pipe, by contact with the fill pipe or restrictor plate 108, the slide lever arm 112 is pushed inwardly. The spout outer spring 113 wraps around the outside of the spout 102 at the straight distal end and interacts with the trigger 111. The latch 115 has its fulcrum 116 as close as possible to the inner curve of the spout 102. The latch hook 119 catches onto the distal or inner side of the restrictor plate. The latch is locked in position by action of the locking pin assembly 130 when fuel pressure causes the locking pin wire 126 to pull the locking pin 139 into the lock recess 132.

Figure 3:
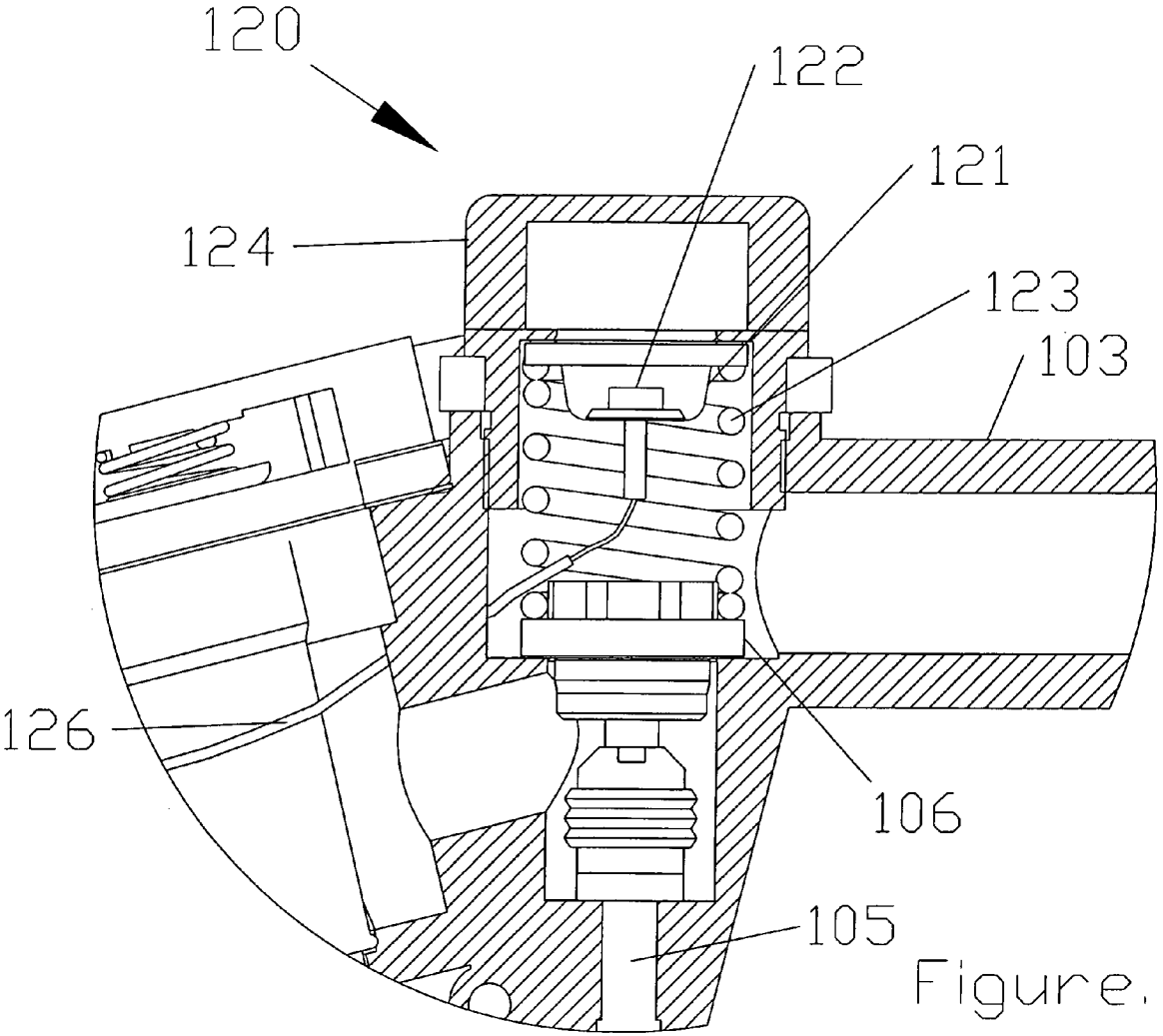
FIG. 3 is a partial side sectional view of the lock actuator assembly shown in FIG. 1.

The elements of the lock actuator assembly 120, featured in FIG. 3, include the diaphragm 121, diaphragm clamp 122, and cable or wire 126.

The actuator diaphragm 121 can be an accordion or elastic type, a rubber gasket that is sensitive to fuel pressure and deforms to transmit the fuel fluid pressure to the locking pin 139 through the actuator wire 126 is preferred. The actuator diaphragm clamp 122 can be a set of dual hardened plastic disks, forming a sandwich with the top portion of the actuator diaphragm 121 lying between the disks, and secured to the diaphragm by a screw or other clamping means. The screw is in turn connected to the one end of actuator wire 126. The locking pin wire, with or without a cable housing, is a small gauge wire that provides the means needed to transmit the movement of the actuator diaphragm 121 to the locking pin 139 connected to the other end of the wire. The wire provides the means by which the tension, or absence of tension, in the actuator diaphragm 121 is communicated to the locking pin assembly 130. The second end of the locking pin wire is attached to the locking pin 139 by a wire lock 133. The locking pin wire is threaded through the nozzle between the actuator diaphragm clamp 122 and lock pin 139.

Figure 4:
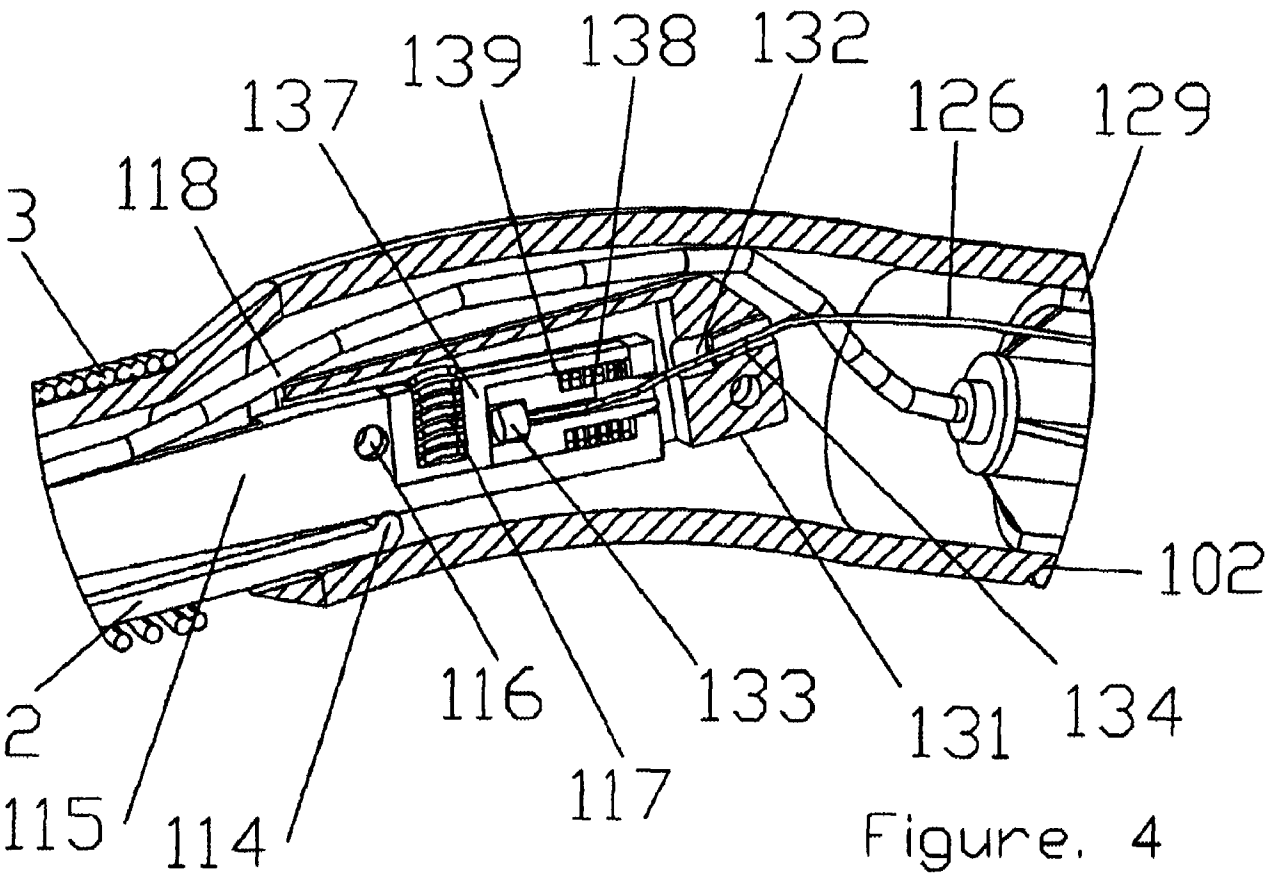
FIG. 4 is a partial side sectional view of the lock assembly shown in FIGS. 1 and 2.

The elements of the locking assembly 130, featured in FIG. 4, include the lock housing 131, the locking pin 139, the lock cap 137, the lock spring 138, and the latch spring 117.

The lock 130 locking pin housing 131 establishes communication between the lock actuator assembly 120 and the grasp assembly 110. The locking pin wire 126 extends between the actuator diaphragm 121 and the locking pin 139. The latch 115 in the locked position is alined with the locking pin housing by means of the locking pin 139 extending into the lock recess 132 in the locking pin housing 131. The locking pin, when extended into the locking pin housing, prevents the latch 115 from pivoting back to the unlocked position even when the trigger 111 with the slide lever arm 112 has been moved back to its at rest position or forward past the latch fulcrum 116. The locking pin cap 137 fits into a cavity or latch recess 136 in the inner end of the latch 115 adjacent the locking pin 139. It houses and is acted on by the latch spring 117 that serves to pivot the latch 115 from the locked position when the locking pin 139 and the trigger 111 are in the unlocked position. This can only happen after the locking pin 139 has been retracted from the lock recess 132 in the locking pin housing 131. The locking pin spring 138 is normally extended toward the distal end of the spout 102.

Fuel pressure moves the lock pin 139 into the lock recess 132 by pulling on the actuator wire compressing the locking pin spring 138. The release of fuel pressure relieves pressure on the actuator cable and enables the locking pin spring 138 to force the lock pin out of the lock recess allowing the latch to be rotated by the latch spring 117 to unlock the locking mechanism.

The locking pin cap spring 117 acts to push down on the inner end of the latch 115 with sufficient force to retract the hook 119 of the latch from the restrictor plate 108 releasing the fuel nozzle from the vehicle. This can only occur when the fuel pressure is shut off deflating the actuator diaphragm 121 allowing the locking pin 139 to retract from the lock recess 132 in the locking pin housing 131. In this position, the locking pin cap spring 117 will extend downward to pivot the latch clockwise and the latch hook 119 away from the restrictor plate.

In operation, to prevent drive off at the gas pump, a trigger 111, under the grasp spring 117 pressure, is moved inward on contact with the fill tube of a gas tank. The trigger 111 is attached to slide arm 112 on its distal outer end and has an inwardly extending knob 114 on its inner end. The knob reciprocates under a grasp fulcrum 116 at an intermediate section of a latch 115. The latch has an extension or hook 119 on its outer end, that can fit under the outer lip 108 of a fill tube flange, and has a locking assembly 130 at its inner end. The latch 115 pivots around the intermediate pin fulcrum 116. As the trigger 111 is moved in, the knob 114 on the slide arm 112 is guided by the spout 102 and moves against grasp spring 113 pressure and against latch spring 117 pressure, as soon as the knob 114 pass the grasp fulcrum 116. The knob 114 moves against the inner end of the arm and rotates it counterclockwise around the grasp fulcrum 116 as it moves inwardly past the grasp pivot point. This counterclockwise rotation of the latch moves the hook 119 on the outer end of the latch outwardly and under the flange 108 of a fill tube to engage the nozzle with the fill tube.

To lock the latch 115 in the engaged position, an elastic, accordion, or other resilient diaphragm 121 is moved out under fuel pressure, created by the fuel pumping system, when the pump is energized by an attendant or customer, and the hand lever 104 is pressed in. A wire or stiff cable 126, that can have a covering, has one inner end attached to the diaphragm, extends to a locking pin 139 attached to its outer end. The locking pin is moved inward, due to fuel pressure causing the wire to pull on the locking pin, against locking spring 138 pressure. The fuel pressure moves the locking pin 139 into a lock recess 132 in locking pin housing 131. The lock housing 131 is stationary with the nozzle and has the opening 132 that can receive the locking pin 139 when the trigger 111 is moved inward. The slide 112 knob 114 after moving past the grasp fulcrum 116 pivots the latch 115 counterclockwise and alines the pivot pin 139 with the lock recess 132 in the lock housing 131. The lock recess 132 has a guide hole or central passage 134 at its base through which the activator cable or wire 126 extends into the locking pin. This guide-hole will receive the wire routed through the body of the fuel nozzle. The activator wire through the lock pin passage 134 guides the locking pin 139 into the lock recess 132. The fuel pressure causes the wire 126 to pull the lock pin 139 into the recess 132 to prevent the latch 115 from being removed from the fill tank pipe. In this position the nozzle cannot be removed from the fill tube.

To remove the nozzle requires the release of the lock pin by removal of fuel pressure, not directly under consumer control. The fuel pump can be shut off only by the station attendant or paying at the pump control. When the fuel pressure is removed, with or without a vacuum assist, the locking pin 139 moves out under lock spring 138 pressure, separating the locking pin 139 from the locking pin housing 131. Removal of the locking pin from the housing permits the latch spring 117 to pivot the latch 115 clockwise around pivot 116 and the latch hook 119 away from the fill tube lip and removal of the nozzle from the fill tube as grasp spring 113 moves the trigger 111 outward.

The locking system 130 could be defeated by purposely wrapping tape around the spout in order to prevent the latch from pivoting out and catching the restrictor plate. A vent valve 118 has been added that will prevent fuel from being pumped while the latch is in the fully retracted position.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing

What is claimed is:

1. An interlocking fuel nozzle comprising:

a grasp means including an interlocking lever adjacent a fuel nozzle spout outer end for attaching said fuel nozzle spout in a fill pipe;

a fuel pressure operated actuator means for locking said grasp means to said fill pipe;

a locking means between said actuator means and said grasp means for controlling locking of said interlocking lever and fuel nozzle spout to said fill pipe.

2. An interlocking fuel nozzle as in claim 1 wherein:

said grasp means is activated by a trigger on said fuel nozzle spout when said fuel nozzle spout is inserted into said fuel fill pipe.

3. An interlocking fuel nozzle as in claim 1 wherein:

said interlocking lever is a latch having an outer end and a inner end;

a latch hook on said latch outer end engages a fill pipe restrictor plate.

4. An interlocking fuel nozzle as in claim 2 wherein:

a slide arm is attached to said trigger;

said interlocking lever is a latch having an outer end and a inner end;

a latch hook on said latch outer end engages a fill pipe restrictor plate;

said slide arm pivots said latch about a grasp fulcrum for securing said latch hook on said latch outer end to said fill pipe restrictor plate.

5. An interlocking fuel nozzle as in claim 4 wherein:

said slide arm has an outer end and an inner end;

said slide arm outer end is secured to said trigger and said slide arm inner end is provided with a knob for pivoting said latch about said grasp fulcrum.

6. An interlocking fuel nozzle as in claim 5 wherein:

said trigger is pressed inward against a grasp spring pressure;

said slide arm knob presses against said latch and against a latch spring pressure.

7. An interlocking fuel nozzle as in claim 1 wherein:

said fuel pressure actuator includes a diaphragm sensitive to fuel pressure;

a connector is attached between said diaphragm and said locking means.

8. An interlocking fuel nozzle as in claim 1 wherein:

said locking means includes a locking pin and a lock recess that engaged firmly secure said interlocking lever on said fuel nozzle spout to said fill pipe.

9. An interlocking fuel nozzle as in claim 8 wherein:

said interlocking lever is a latch with an outer end and an inner end;

said lock recess is in a lock housing in said fuel nozzle;

said locking pin is housed within said latch inner end.

10. An interlocking fuel nozzle as in claim 9 wherein:

said locking pin reciprocates within said latch inner end and is pressed toward said fuel nozzle spout outer end by a lock pin spring pressure.

11. An interlocking fuel nozzle as in claim 10 wherein:

said lock recess base is provided with a passage in its base for passage of a fuel pressure actuator connector;

said fuel pressure actuator connector pulls said locking pin inward against said lock pin spring toward said lock recess when fuel pressure is present in said fuel nozzle.

12. An interlocking fuel nozzle as in claim 9 wherein:

said lock recess in said lock housing is stationary within, said fuel nozzle;

said lever and said locking pin pivot about a centrally located grasp fulcrum in said lever;

said locking pin and said lock recess are alined when said lever is pivoted counterclockwise with said lever outer end pivoted out into a locking position.

13. An interlocking fuel nozzle as in claim 12 wherein:

a passage is provided in said lock recess base;

said actuator means includes a diaphragm;

a fuel actuator connector extends from said actuator diaphragm through said lock recess passage to said lock pin.

14. An interlocking fuel nozzle as in claim 3 including:

a latch recess, having an outer end and an inner end, in said latch inner end;

a lock cap and latch spring held in said outer end of said latch recess;

a lock pin and a lock pin spring held in said inner end of said latch recess.

15. An interlocking fuel nozzle as in claim 14 wherein:

said grasp means is activated by a trigger on said fuel nozzle spout when inserted into said fuel fill pipe;

said trigger is attached to a slide arm that pivots a latch about a grasp fulcrum for securing and unsecuring a latch hook on said latch outer end to said fill pipe restrictor plate;

said slide arm outer end is secured to said trigger and said slide arm inner end is provided with a knob for pivoting said latch about said grasp fulcrum;

said fuel pressure actuator includes a diaphragm sensitive to fuel pressure;

a connector is attached between said diaphragm and said locking means;

said latch spring presses said latch clockwise for releasing said latch from said fill pipe;

said slide arm knob presses said latch counterclockwise for securing said latch to said fill pipe when said slide arm knob is inward past said grasp fulcrum;

said connector under fuel pressure pulls said lock pin toward said lock recess;

said lock pin spring presses said lock pin away from said lock pin recess.

16. An interlocking fuel nozzle as in claim 3 including:

a slot in said spout outer end;

said latch hook fits through said slot in said spout to engage said fill pipe.

17. An interlocking fuel nozzle as in claim 16 wherein:

said grasp means is activated by a trigger on said fuel nozzle spout when said fuel nozzle is inserted into said fuel fill pipe;

said trigger is attached to a slide arm that pivots a latch about a grasp fulcrum for securing and unsecuring a latch hook on said latch outer end to said fill pipe restrictor plate;

a grasp spring presses said trigger and said slide arm knob outward to permit said latch to be pivoted clockwise and to retract said latch hook from engagement with said fill pipe.

* * * * *